US005197319A

United States Patent [19]

Beekel et al.

[11] Patent Number: 5,197,319

[45] Date of Patent: Mar. 30, 1993

[54] EXTRUSION APPARATUS FOR SHEATHING A TEMPERATURE SENSITIVE CORE MATERIAL

[75] Inventors: Eugene A. Beekel; Stephen L. Hickman, both of Adrian, Mich.

[73] Assignee: Brazeway, Inc., Adrian, Mich.

[21] Appl. No.: 802,538

[22] Filed: Dec. 5, 1991

[51] Int. Cl.[5] ..... B21C 23/30

[52] U.S. Cl. ..... 72/268

[58] Field of Search ..... 72/268

[56] References Cited

U.S. PATENT DOCUMENTS 2,385,574 9/1945 Hyprath ..... 72/268

3,469,431 9/1969 Deina ..... 72/268

FOREIGN PATENT DOCUMENTS 223114 12/1984 Japan ..... 72/268

241323 9/1989 Japan ..... 72/268

*Primary Examiner*—Lowell A. Larson

*Attorney, Agent, or Firm*—Krass & Young

[57] ABSTRACT

An apparatus for extruding a sheath or cladding about a temperature sensitive core material wherein the melting point of the core material is lower than the temperature of the extruded sheath or cladding. The apparatus utilizes a cooling chamber separated from said extrusion die assembly to cool the core material prior to the core material entering the extrusion die assembly.

10 Claims, 1 Drawing Sheet

EXTRUSION APPARATUS FOR SHEATHING A TEMPERATURE SENSITIVE CORE MATERIAL

INTRODUCTION

This invention relates to an apparatus used to extrude a sheath or cladding over a core material having a melting point lower than the extrusion temperature of the sheath or cladding.

BACKGROUND OF THE INVENTION

Extrusion machines have been used for many years to extrude both solid and tubular products and to apply a sheath or cladding over a core material. In many instances the extrusion temperature at which the sheath material is extruded is significantly greater than the melting point of the core material. Additionally, an adhesive, having a melting point lower than the extruded sheath material, is sometimes placed on the core material to aid in bonding the core material to the sheath. A difference in temperatures of the sheath and core materials can create such problems as the core material sticking to the extruded sheath or a premature activation of the adhesive.

When extruding an aluminum sheath over an insulating polymer core, such as in the manufacture of co-axial cable, the sheath material is normally extruded having a greater inner diameter than the outer diameter of the inner core. This results in the core material being loose and free to move within the sheath after the extrusion process. Once cool, the sheath and core go through a draw die which reduces the sheath O.D. and bonds the sheath to the inner core. During the drawing process the sheath is elongated. As the sheath is elongated, the core material must be free within the sheath to feed through the sheath as the sheath is drawn around it. If the core material adheres to the sheath prior to the sheath entering the draw die, the subsequent elongation of the sheath results in the core material breaking, rather than feeding through the sheath as desired.

Accordingly, it is the object of the present invention to provide an extrusion apparatus which sufficiently cools the core material prior to passing the core material through the extrusion assembly so that the precooling of the core material prevents the core from sticking to the extruded sheath to thereby avoid breakage of the core material during the drawing process.

SUMMARY OF THE INVENTION

In accordance with the invention, an apparatus for extruding a sheath about a temperature sensitive core material is provided. The apparatus comprises an extrusion die assembly utilizing a die ring and a hollow mandrel wherein the mandrel is placed in spaced relationship with the die ring to form an annular path for the extrusion of the sheath about a core material passing through the hollow mandrel. A cooling chamber spaced from the extrusion die assembly contains a cooling fluid which surrounds and cools the core material as it passes immersibly through the chamber. The cooling fluid reduces the temperature of the core material, allowing it to pass through the hot zone of the extruder without being raised to a critical temperature which allows bonding to the sheath.

In addition, an insulator may be used between the cooling chamber and the extrusion die assembly. The insulator surrounds the core material as it exits the cooling chamber and maintains the core material at a desired temperature. Additionally, the insulator may have an inner diameter slightly greater than the outer diameter of the core material to allow entrained cooling fluid to travel with the core material through the insulator thus maintaining the core material at the desired temperature.

DETAILED DESCRIPTION OF AN ILLUSTRATED EMBODIMENT

Figure 1:
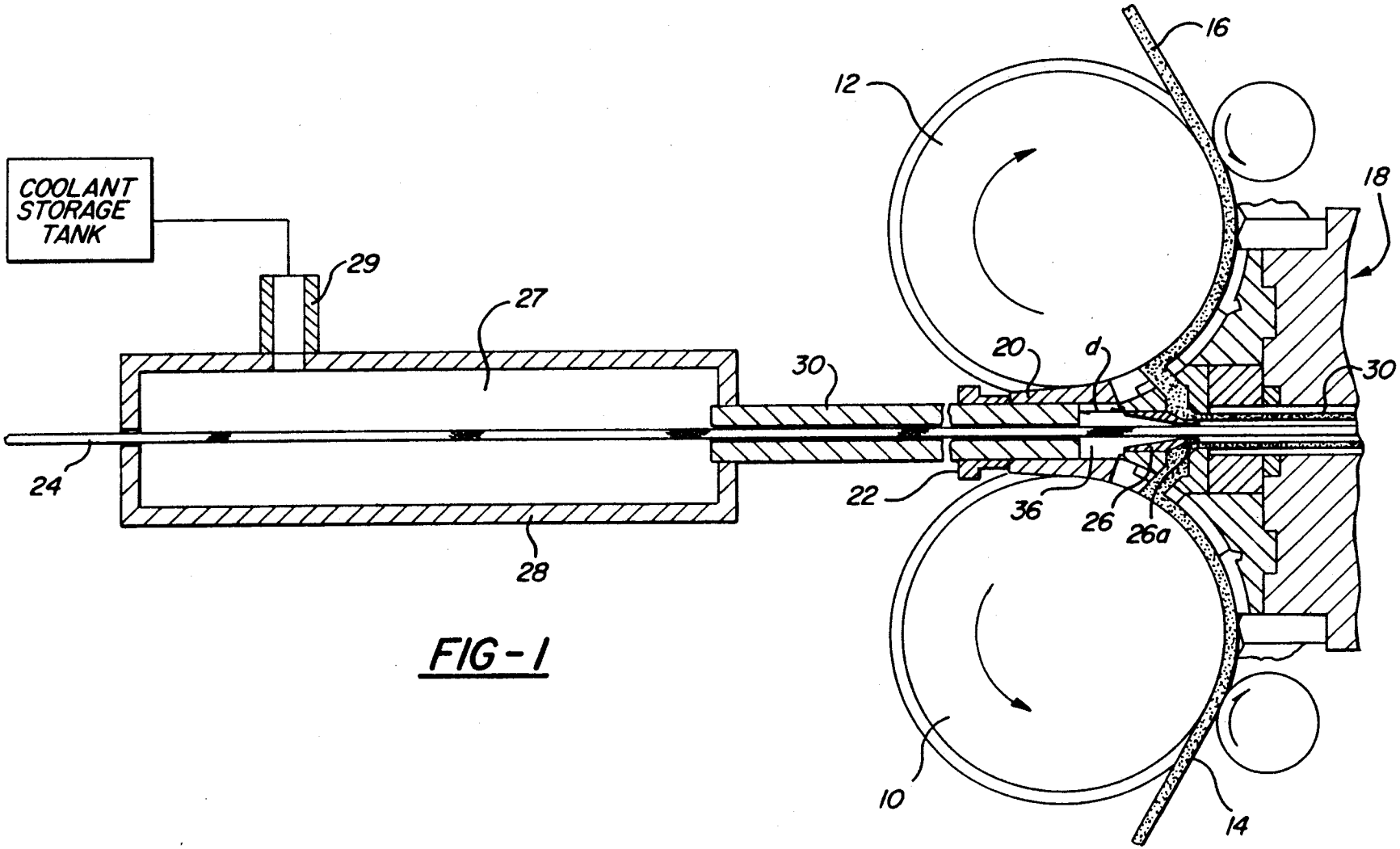
FIG. 1 is a cross section elevational view of the present invention.

As shown in FIG. 1, an extrusion apparatus includes a pair of stock feed wheels 10 and 12 having vertical parallel spaced axes of rotation for feeding aluminum rod stock 14 and 16 into an extrusion die assembly 18 having a horizontal axial output path. The die assembly 18 and abutment holder 20 are inserted in the extrusion machinery and held against a fixed stop 22. A door or locking assembly, (not shown) attached to the machine frame is used to retain the die assembly and abutment holder against the fixed stop lock 22. Further details of extrusion machinery of this type may be found in U.S. Pat. No. 5,000,025, assigned to the assignee of the subject application, the disclosure of which is incorporated herein by reference.

As shown in FIG. 1, both the fixed stop 22 and the abutment 20 have axial bores therein to allow passage of the core material 24 through the mandrel 26 of the extrusion of the die assembly 18.

A bath including a cooling chamber 28 containing a cooling fluid 27 therein is spaced from the die assembly 18. The chamber 28 includes an inlet port 29 through which the cooling fluid 27, kept in a storage tank, enters the cooling chamber 28. The cooling fluid used herein is liquid nitrogen having a temperature of −320° F. Liquid nitrogen is used to prevent moisture from occurring either within the core material or between the core material and sheath.

The size of the chamber varies depending upon the size and type of the core material. Applicant has found that a 2½ inch I.D. by 7 foot long cooling chamber having reducers at each end is of sufficient size to cool a ½ inch steel cable having a polymer outer layer.

Additionally, an insulator 30 extends from the cooling chamber 28 to the fixed stop 22. The purpose of the insulator is to maintain the temperature of the cable after exiting the cooling chamber. The distance (d) between end of the insulator and the tip of the mandrel may be varied to prevent the super cooled cable from drawing too much heat away from the tip of the mandrel and affecting the extrusion process.

As shown, the mandrel 26 has an entrance sufficient to allow a clearance of the core material without touching the sides of the mandrel. Note the area of the mandrel **26*a*** having closest contact to the core must be maintained at a minimum to assure that the hot mandrel does not damage the core. By designing the mandrel to have a frusto-conical shaped interior, any cooling fluid accompanying the core material through the insulator is drawn along between the core material and the mandrel and aids in keeping the core material cool through the extrusion process.

The sheath is extruded with a gap or space between the core 24 and the sheath 30. Once extruded, both the sheath and the core go through a water cooling station (not shown) prior to passing through a drawing die (not shown) which draws the sheath 30 tightly around the core material 24. During the extrusion process, some of the cooling fluid escapes through the mandrel tip 26*a* and is present in the gap between the core 24 and the extruded sheath 30 and continues to cool the core 24 until the sheath 30 is cooled at the water cooling station.

By varying the length of the cooling chamber, various degrees of cooling can be accomplished. The use of the liquid nitrogen is advantageous because it does not create moisture within the sheath. By placing the cooling chamber 28 away from the mandrel 26, the super cooled nitrogen does not affect the extrusion process. Further, the use of the insulator 30 acting as a reducer allows only a small amount of the liquid nitrogen to flow along with the core 24 through to the mandrel 26.

In certain uses, the insulator 30 may becomes a conductor rather than an insulator to conduct additional cooling to the die assembly. Thus, the conductor is also cooled and provides a heat transfer point to the abutment holder 20 and fixed stop 22. A cavity 36 is formed in the space between the insulator 30 and the mandrel 26. The size of the cavity 36 may be varied by increasing or decreasing the distance (d) between the insulator 30 and the mandrel 36. Increasing the size of the cavity 36 results in a greater heat transfer between the cooling fluid 27 and the die assembly 18. Thus any cooling fluid 27 pulled through the mandrel tip 26*a* along with the core material 24 by a vacuum effect resulting from the extrusion of the sheath 32 is warmed and does not effect the extrusion process.

The aforementioned apparatus will be seen to provide a means by which a core material may be cooled at a point spaced from the extrusion machinery so that the cooling process does not affect the extrusion process. The core material may be solid or stranded wires and may be precoated with a polymer coating prior to the extrusion of an aluminum cladding or sheath about the core material.

Although a preferred embodiment of the invention has been illustrated and described in detail, it will be apparent that various changes may be made in the disclosed embodiment without departing from the scope or spirit of the invention.

What is claimed is:

1. An apparatus for extruding a sheath about a temperature sensitive core material traveling along a feed path comprising an extrusion die assembly located along the feed path and having a die ring and a hollow mandrel coacting with said die ring to form an annular path for the extrusion of the sheath about the core material passing through said mandrel; means defining a bath located along said path upstream of the extrusion die assembly and including a cooling chamber containing a cooling fluid; and means for passing the core material immersibly through the bath so that the cooling fluid surrounds, contacts, and cools the core material prior to entering the extrusion die assembly.

2. An apparatus according to claim 1 including a tubular insulator surrounding said core material and extending from the outlet of the cooling chamber to the inlet of the extrusion die assembly.

3. An apparatus according to claim 2 wherein said insulator extends into said extrusion die assembly and is placed adjacent the mandrel.

4. An apparatus according to claim 2 wherein said insulator has an inner diameter greater than the outer diameter of the core material so that the cooling fluid entrained on the core material by the immersion of the core material in the bath may pass between the insulator and the core material so as to continue to cool the core material as the core material moves through the insulator to the extrusion die assembly.

5. An apparatus according to claim 2 wherein said insulator is inserted in the extrusion die assembly and spaced from said mandrel to form a cavity and wherein the size of said cavity may be varied to vary the cooling capacity of the apparatus.

6. The apparatus according to claim 1 wherein said mandrel has an entrance section and an exit section, said mandrel between said entrance and exit section having a frusto-conical shaped interior, whereby the surface area of the mandrel contacting the core material is maintained at a minimum to minimize damage to the core material.

7. A method of forming a sheath about a temperature sensitive core material traveling along a feed path comprising the steps of cooling said core material at a first station along said feed path by passing said core material immersibly through a liquid bath and extruding said sheath about said core material at a second station spaced downstream of the first station.

8. An apparatus according to claim 1 wherein the cooling fluid is a liquid so that the core material is wetted as it passes through the bath.

9. An apparatus according to claim 8 wherein the cooling liquid is maintained as a sub-zero temperature.

10. An apparatus according to claim 9 wherein the cooling liquid is liquid nitrogen.

* * * * *